US009053652B2

(12) United States Patent
Tamura et al.

(10) Patent No.: US 9,053,652 B2
(45) Date of Patent: Jun. 9, 2015

(54) DISPLAY CONTROL DEVICE, DISPLAY CONTROL METHOD, AND PROGRAM

(75) Inventors: Kenichi Tamura, Kanagawa (JP); Ikuya Sano, Chiba (JP); Yasushi Itoshiro, Saitama (JP); Yoshio Ito, Tochigi (JP); Yoshiyuki Nida, Saitama (JP)

(73) Assignee: Sony Corporation, Tokyo (JP)

( * ) Notice: Subject to any disclaimer, the term of this patent is extended or adjusted under 35 U.S.C. 154(b) by 952 days.

(21) Appl. No.: 12/651,130

(22) Filed: Dec. 31, 2009

(65) Prior Publication Data

US 2010/0171693 A1 Jul. 8, 2010

(30) Foreign Application Priority Data

Jan. 6, 2009 (JP) ..... P2009-001155

(51) Int. Cl.
*G09G 5/00* (2006.01)

(52) U.S. Cl.
CPC ..... *G09G 5/003* (2013.01); *G09G 2340/0492* (2013.01)

(58) Field of Classification Search
CPC ..... G09G 2340/0492; G09G 5/003
USPC ..... 345/55, 168–169, 175, 156, 158, 345/171–174
See application file for complete search history.

(56) References Cited

U.S. PATENT DOCUMENTS

| | | | | |
|---|---|---|---|---|
| 2003/0034185 | A1* | 2/2003 | Kaikuranta | 178/18.01 |
| 2004/0036680 | A1* | 2/2004 | Davis et al. | 345/169 |
| 2004/0080468 | A1* | 4/2004 | Wakefield | 345/55 |
| 2009/0085870 | A1* | 4/2009 | Mosko | 345/158 |
| 2009/0102796 | A1* | 4/2009 | Harris | 345/168 |
| 2009/0209285 | A1* | 8/2009 | McMahan | 455/556.1 |
| 2009/0262078 | A1* | 10/2009 | Pizzi | 345/169 |

FOREIGN PATENT DOCUMENTS

| | | |
|---|---|---|
| JP | 2005-18229 | 1/2005 |
| JP | 2008-158337 | 7/2006 |
| JP | 2007-109240 | 4/2007 |
| JP | 2008-203726 | 9/2008 |

* cited by examiner

*Primary Examiner* — Quan-Zhen Wang
*Assistant Examiner* — Tony Davis
(74) *Attorney, Agent, or Firm* — Sherr & Jiang, PLLC

(57) ABSTRACT

A display control device includes a cabinet, a detection unit configured to detect an orientation of the cabinet, a display screen, and a display control unit configured to control display of the display screen in accordance with the orientation of the cabinet detected by the detection unit.

17 Claims, 9 Drawing Sheets

FIG. 6

131

| Keio Inokashira Line Nishi-eifuku Station: For Kichijoji 12:15 AM | | |
|---|---|---|
| First Train | 12:19 | Bound for Kichijoji |
| | 12:24 | Bound for Kichijoji |
| | 12:27 | Bound for Kichijoji |
| Rapid | 12:32 | Bound for Kichijoji |
| | 12:36 | Bound for Kichijoji |
| | 12:42 | Bound for Kichijoji |
| | 12:50 | Bound for Kichijoji |
| ⚠ Operational Information 11:58 Delayed (10 min. or more) | | |

132

| ⚠ Railroad Information | |
|---|---|
| 11:58 | Keio Inokashira Line: Delayed (10 min. or more)<br>Due to strong wind |
| 11:51 | Asakusa Line: Stopped<br>Due to strong wind |
| 11:32 | Toei Mita Line: Delayed (10 min. or more)<br>Traffic Light Failure |
| 10:42 | Tobu Tojo Line: Stopped<br>Traffic Light Failure |
| (BACK) Return ⊕ Accept | (OPTIONS) Detailed Information |

133

Weather Near Tokyo Station 12:15 AM
Updated at 12:00, March 20, 2008

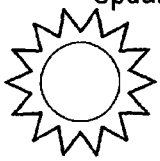
20 (Mon.)
23/18°C
10%

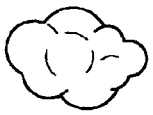
21 (Tue.)
23/18°C
10%

| 22 (Wed.) | 23 (Thur.) | 24 (Fri.) | 25 (Sat.) | 26 (Sun.) | 27 (Mon.) |
|---|---|---|---|---|---|
| 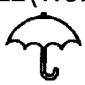 | 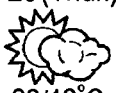 | 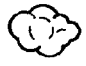 | 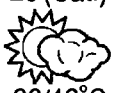 | 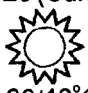 | 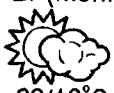 |
| 23/18°C<br>10% | 23/18°C<br>10% | 23/18°C<br>10% | 23/18°C<br>10% | 23/18°C<br>10% | 23/18°C<br>10% |

DISPLAY CONTROL DEVICE, DISPLAY CONTROL METHOD, AND PROGRAM

BACKGROUND OF THE INVENTION

1. Field of the Invention

The present invention relates to a display control device, a display control method, and a program, and more particularly to a display control device, a display control method, and a program that enable display control in accordance with the orientation of a cabinet.

2. Description of the Related Art

In recent years, when a content item such as an image or a document is displayed on the display screen of a terminal apparatus, the display orientation of the content item is changed by, for example, rotating the image 90 degrees on the display screen. In addition, even when the user does not change the display orientation explicitly, the image is rotated according to the aspect ratio of the display screen.

For example, Japanese Unexamined Patent Application Publication No. 2005-18229 discloses a document viewing terminal that performs portrait or landscape display according to the content item such as a document displayed on the display screen. The document viewing terminal described in Japanese Unexamined Patent Application Publication No. 2005-18229 can change the display orientation of the content item in accordance with the orientation of the terminal, and display the content item in portrait or landscape display, which is more suitable, based on the display attribute of the content item to be displayed.

SUMMARY OF THE INVENTION

In recent years, many apparatuses such as a mobile phone can obtain various types of information via the Internet etc. In this case, the user can search for desired information using a terminal apparatus connected to the Internet etc. and display the information on the display screen. News, weather forecast, or other information frequently accessed by the user is searched for every time and displayed on the display screen.

The above document viewing terminal can change the display orientation of a content item in accordance with the orientation of the terminal, but the terminal does not switch the displayed data of the content item in accordance with the orientation of the terminal. If a change of the orientation of the terminal switches the content item to be displayed on the display screen to a content item frequently accessed by the user, it is not necessary to search for desired information, thereby increasing user convenience.

It is desirable to provide a novel and improved display control device, a display control method, and a program that can switch the displayed data appropriately in accordance with the orientation of the cabinet.

According to an embodiment of the present invention, there is provided a display control device including a cabinet, a detection unit configured to detect an orientation of the cabinet, a display screen, and a display control unit configured to control display of a display screen in accordance with the orientation of the cabinet detected by the detection unit. The display control device further includes operation means operated by a user and a function control unit configured to control a function of the operation means in accordance with the orientation of the cabinet detected by the detection unit.

In the above-described configuration, the orientation of the cabinet is detected, display can be changed appropriately in accordance with the detected orientation of the cabinet, and the functions of operation means including operation buttons can be controlled appropriately. As a result, the displayed data can be switched appropriately in accordance with the orientation of the cabinet.

The display control unit may control the display of operation buttons corresponding to the operation means in accordance with the orientation of the cabinet detected by the detection unit.

The detection unit detects whether the cabinet is in a first orientation or in a second orientation in accordance with the slant of the cabinet; when the detection unit detects that the cabinet is in the first orientation, the display control unit may set a first display mode in which given information displayed on the display screen is selectable by a user operation; when the detection unit detects that the cabinet is in the second orientation, the display control unit may set a second display mode in which preset given information is displayed on the display screen.

The function control unit may enable the operation means operated by the user in the first display mode and may disable the operation means in the second display mode.

The cabinet may be rectangular-parallelepiped-shaped, the longitudinal direction of the cabinet may be the horizontal direction in the first orientation, and the longitudinal direction of the cabinet may be the vertical direction in the second orientation.

The operation means may be provided at one end in the longitudinal direction of the rectangular-parallelepiped-shaped cabinet, the display control unit may display the operation button corresponding to the operation means when the cabinet is in the first orientation, and the function control unit may enable the operation means when the display control unit displays the operation button.

The display control unit may hide the operation button corresponding to the operation means when the cabinet is in the second orientation and the function control unit may disable the operation means when the display control unit hides the operation button.

According to another embodiment of the present invention, there is provided a display control method including the steps of detecting a slant of a cabinet, determining whether the cabinet is in a first orientation or in a second orientation in accordance with the detected slant of the cabinet, setting a first display mode in which given information displayed on a display screen is selectable by a user operation when the cabinet is in the first orientation, and setting a second display mode in which preset given information is displayed on the display screen when the cabinet is in the second orientation.

According to another embodiment of the present invention, there is provided a program for causing a computer to operate as a display control device including a cabinet, a detection unit configured to detect an orientation of the cabinet, a display screen, a display control unit configured to control display of the display screen in accordance with the orientation of the cabinet detected by the detection unit, operation means operated by a user and a function control unit configured to control a function of the operation means in accordance with the orientation of the cabinet detected by the detection unit.

As described above, according to the embodiments of the present invention, the displayed data can be switched appropriately in accordance with the orientation of the cabinet.

BRIEF DESCRIPTION OF THE DRAWINGS

FIG. 6 illustrates a display example when a cabinet according to the embodiment is in the horizontal orientation.

DESCRIPTION OF THE PREFERRED EMBODIMENTS

Figure 1:
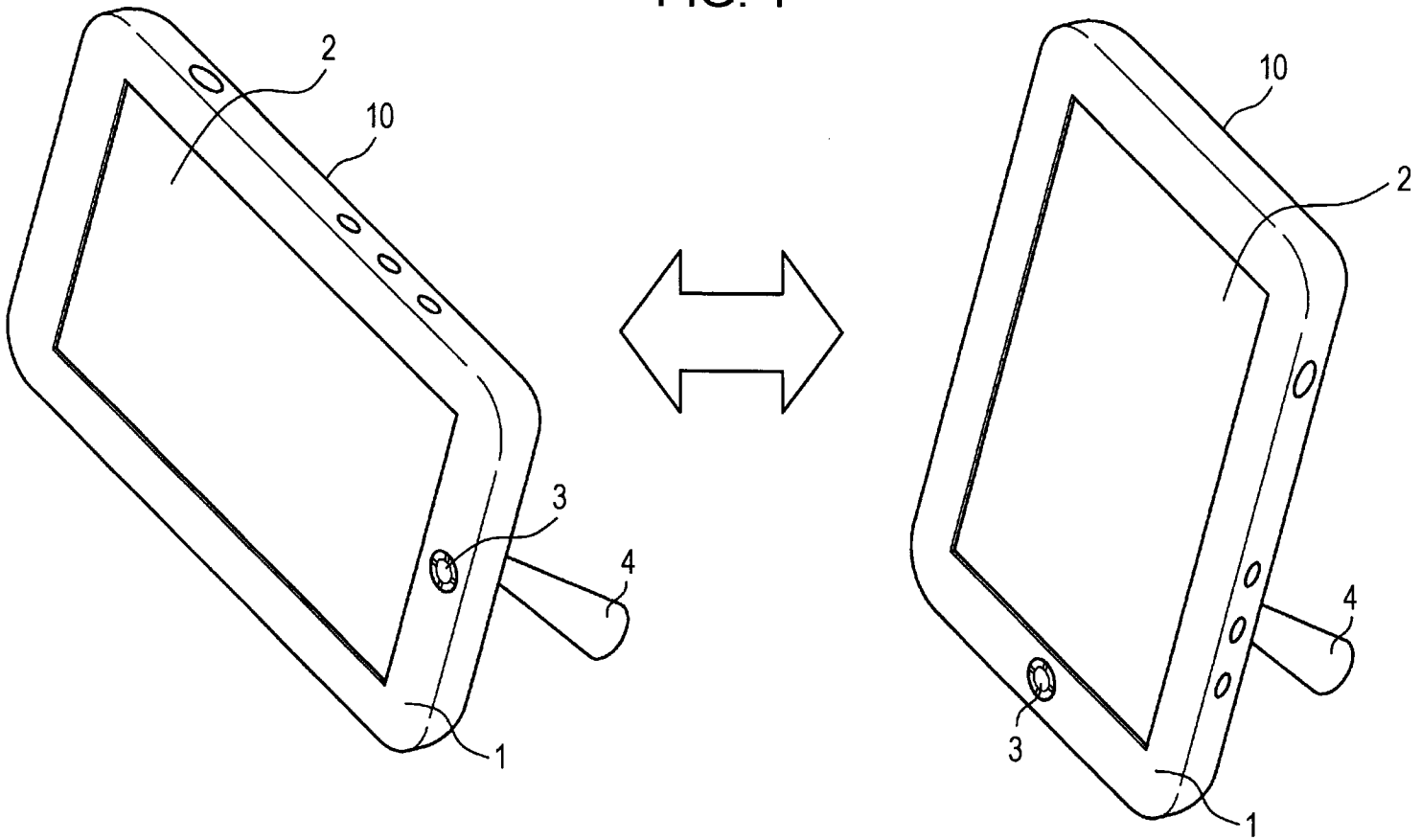
FIG. 1 is a schematic diagram illustrating a display control device according to an embodiment of the present invention.

A preferred embodiment of the present invention will now be described below with reference to the drawings. In the specification and drawings, components with substantially identical functions are indicated by identical reference numerals to omit repeated descriptions.

The preferred embodiment will be described in the following order.

[1] Problem addressed by the present embodiment

[2] Overview of the display control device

[3] Hardware configuration of the display control device

[4] Functional configuration of the display control device

[5] Operation of the display control device

[6] Display example of the display control device

[1] Problem Addressed by the Present Embodiment

First, a problem addressed by the embodiment of the present invention will be described. In recent years, when a content item such as an image or a document is displayed on the display screen of a terminal apparatus, the display orientation of the content item is changed by, for example, rotating the image 90 degrees on the display screen. In addition, even when the user does not change the display orientation explicitly, the image is rotated according to the aspect ratio of the display screen.

As an example of the terminal that can change the display orientation of a content item, there is a document viewing terminal that performs portrait or landscape display according to the content item such as a document displayed on the display screen. This document viewing terminal can change the display orientation of the content item in accordance with the orientation of the terminal, and display the content item in portrait or landscape display, whichever is more suitable, based on the display attribute of the content item to be displayed.

In recent years, many apparatuses such as a mobile phone can obtain various types of information via the Internet etc. In this case, the user can search for desired information with a terminal apparatus connected to the Internet etc. and display the information on the display screen. News, weather forecast, or other information frequently accessed by the user is searched for every time and displayed on the display screen.

The above document viewing terminal can change the display orientation of a content item in accordance with the orientation of the terminal, but the terminal does not switch the displayed data of the content item in accordance with the orientation of the terminal. If a change of the orientation of the terminal switches the content item to be displayed on the display screen to a content item frequently accessed by the user, it is not necessary to search for desired information, thereby increasing user convenience.

A display control device 10 according to an embodiment of the present invention has been considered due to the above reasons. The display control device 10 according to the present embodiment can switch the displayed data appropriately in accordance with the orientation of the cabinet.

[2] Overview of the Display Control Device

An overview of the display control device 10 according to the embodiment of the present invention will be described below with reference to FIG. 1. FIG. 1 schematically illustrates the display control device 10 according to the embodiment. As shown in FIG. 1, the display control device 10 includes, for example, a cabinet 1 with a frame, a display unit 2, an operation button 3, a supporting foot 4, etc.

The present embodiment will be exemplified by the display control device 10 shaped like a picture frame as shown in FIG. 1, but the display control device 10 is not limited to this example. An embodiment of the present invention is applicable to information processing terminals with a display device, such as mobile phones, PDAs (personal digital assistants), or compact PCs (personal computers).

The cabinet 1 has the frame surrounding the display unit 2 and the frame has an operation means such as the operation button 3. The frame further has a user-operable touch sensor, a switch, a lamp, etc. In addition, the frame has a communication device for connecting to the Internet etc. and a drive for reading and writing information in a memory card etc.

The display unit 2, which is a display apparatus for displaying a content item such as an image or a document, can be exemplified by a CRT (cathode ray tube) display device, a liquid crystal display (LCD) device, an OLED (organic light emitting display) device, etc.

The supporting foot 4, which is attached to the cabinet 1, supports the cabinet 1 with the display unit 2 facing obliquely upward. In addition, the cabinet 1 can be placed in the horizontal or vertical orientation because the cabinet 1 is supported by the supporting foot 4.

The display control device 10 according to the present embodiment is shaped like a picture frame as shown in FIG. 1 and the user can easily place the cabinet 1 of the display control device 10 in the horizontal or vertical orientation. The display control device 10 has a tilt sensor (not shown) for detecting the slant of the cabinet 1. The display control device 10 detects whether the cabinet 1 is in the horizontal orientation or in the vertical orientation with the tilt sensor and controls display in accordance with the orientation of the cabinet 1. Display control according to the orientation of the cabinet 1 will be described in detail later.

[3] Hardware Configuration of the Display Control Device

An overview of the display control device 10 has been described above. Next, the hardware configuration of the display control device 10 will be described with reference to FIG. 2.

Figure 2:
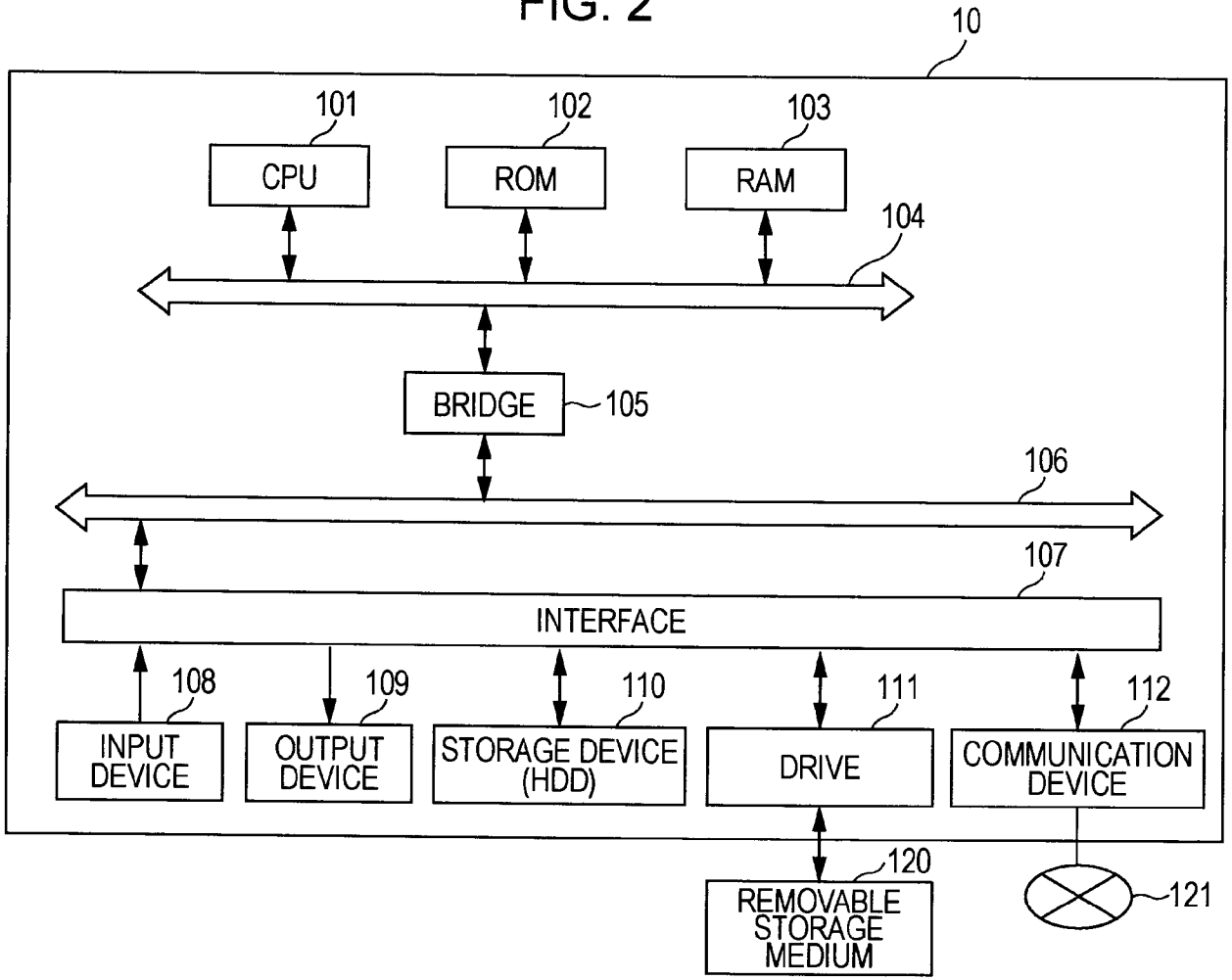
FIG. 2 is a block diagram illustrating the hardware configuration of the display control device according to the embodiment.

FIG. 2 illustrates the hardware configuration of the display control device 10 according to the present embodiment. As shown in FIG. 2, the display control device 10 has a CPU (central processing unit) 101, a ROM (read only memory) 102, a RAM (random access memory) 103, a host bus 104, a bridge 105, an external bus 106, an interface 107, an input device 108, an output device 109, a storage device (HDD) 110, a drive 111, and a communication device 112.

The CPU 101 functions as a computation device and control device and controls the entire operation within the display control device 10 according to various programs. The CPU 101 may be a microprocessor. The ROM 102 stores programs, computation parameters, etc. used by the CPU 101. The RAM 103 temporarily stores programs used during operation of the CPU 101 and parameters changing as appropriate during the operation. These components are mutually connected via the host bus 104 including a CPU bus etc.

The host bus 104 is connected to the external bus 106 such as the PCI (peripheral component interconnect/interface) bus via the bridge 105. The host bus 104, the bridge 105, and the external bus 106 are not necessarily mutually separated and these components may be implemented as one bus.

The input device 108 has an input unit, used by the user for data input, such as a mouse, a keyboard, a touch panel, a button, a microphone, a switch, and a lever; and an input control circuit that generates an input signal based on the user input and outputs the input signal to the CPU 101. The user of the display control device 10 can input various types of data or give a processing command to the display control device 10 by operating the input device 108.

When the display control device 10 is shaped like a picture frame as shown in FIG. 1, the operation button or the appropriate section of the touch panel disposed on the frame of the cabinet 1 is pressed. The user can switch the content item displayed on the display unit 2 or select desired information by pressing the operation button etc.

The output device 109 has a display device such as a CRT (cathode ray tube) display device, a liquid crystal display (LCD) device, an OLED (organic light emitting display) device, or a lamp and a sound output device such as a speaker or headphone. The display device displays image data or other types of information as text or images. The sound output device converts sound data etc. into sound and outputs it.

The storage device 110 is a data storage device configured as an example of the storage unit of the display control device 10 according to the present embodiment. The storage device 110 may include a storage medium, a storage device that stores data in the storage medium, a read device that reads data from the storage medium, and a deletion device that deletes data stored in the storage medium. The storage device 110 includes, for example, a HDD (hard disk drive). The storage device 110 drives the hard disk drive and stores programs to be executed by the CPU 101 and various types of data. The storage device 110 stores, for example, content data of images or documents, meta data, and device data.

The drive 111, which is a reader/writer for storage media, is built into or externally added to the display control device 10. The drive 111 reads information stored in a removal storage medium 120 such as a mounted magnetic disc, optical disc, magnetic optical disc, or semiconductor memory and outputs the information to the RAM 103.

The communication device 112 is a communication interface including components such as a communication device for connecting to a communication network 121, for example. The communication device 112 may be a wireless LAN (local area network) communication device, a wireless USB communication device, or a wired communication device that performs wired communication. The communication device 112 can obtain various types of information by connecting to the Internet via the communication network 121. The communication device 112 can also display a content item such as an image on the display unit 2 using an application or the like provided on the Internet.

[4] Functional Configuration of the Display Control Device

The hardware configuration of the display control device 10 has been described above. Next, the functional configuration of the display control device 10 according to the present embodiment will be described with reference to FIG. 3.

Figure 3:
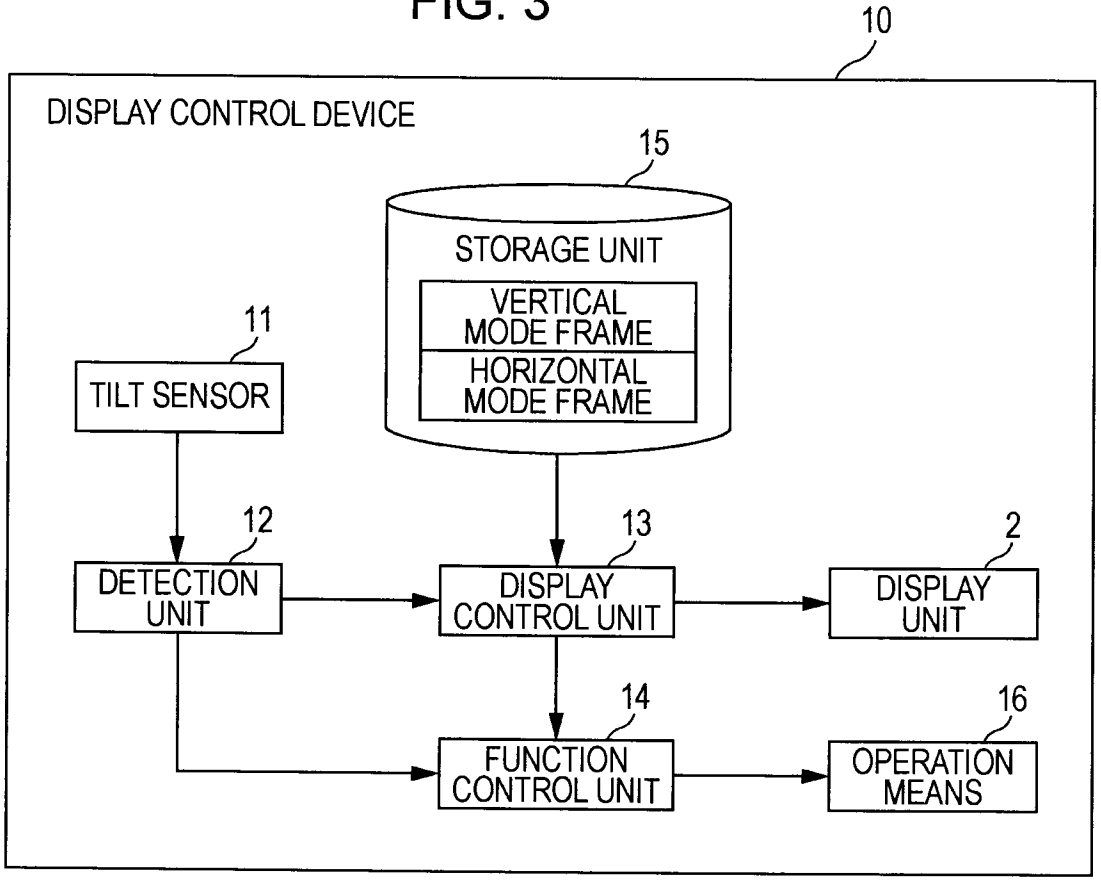
FIG. 3 is a block diagram illustrating the functional configuration of the display control device according to the embodiment.

FIG. 3 is a block diagram illustrating the functional configuration of the display control device 10 according to the present embodiment. As shown in FIG. 3, the display control device 10 according to the present embodiment mainly includes a tilt sensor 11, a detection unit 12, a display control unit 13, a function control unit 14, a storage unit 15, an operation means 16, and the display unit 2.

The tilt sensor 11 may be, for example, a gyro sensor, a mechanical or optical four-direction detection sensor, or other sensors that can detect the slant of the cabinet 1. The gyro sensor can detect the slant of the cabinet 1 by measuring angular velocity. The mechanical or optical four-direction detection sensor, which is a device for detecting four directions using infrared LEDs, transistors, or other components, can detect the slant or orientation of the cabinet 1. The slant of the cabinet 1 detected by the tilt sensor 11 is provided for the detection unit 12.

The detection unit 12 has a function of detecting the orientation of the cabinet 1 based on the slant of the cabinet 1 provided by the tilt sensor 11. The orientation of the cabinet 1 includes, for example, the horizontal orientation in which the longitudinal direction of the cabinet 1 is the horizontal direction and the vertical orientation in which the longitudinal direction of the cabinet 1 is the vertical direction, as shown in FIG. 1. The horizontal orientation is an example of a first orientation according to an embodiment of the present invention and the vertical orientation is an example of a second orientation according to an embodiment of the present invention.

In present embodiment, the case where the cabinet 1 is in the vertical orientation and the case where the cabinet 1 is in the horizontal orientation are described, but the present invention is not limited to these examples. For example, when the cabinet 1 is supported by the supporting foot 4 with the cabinet 1 slanted, whether the cabinet 1 is slanted may be detected. In addition, when the cabinet 1 is rotatable, the rotation speed etc. may be detected.

The display control unit 13 has a function of controlling the display of the display unit 2 in accordance with the orientation of the cabinet 1 detected by the detection unit 12. As described above, the detection unit 12 detects whether the cabinet 1 is in the vertical orientation or in the horizontal orientation. The display control unit 13 switches the displayed data on the display unit 2 depending on whether the cabinet 1 is in the vertical orientation or in the horizontal orientation. The display control unit 13 may turn on or off a lamp disposed on the frame of the cabinet 1 depending on whether the cabinet 1 is in the vertical orientation or in the horizontal orientation.

Specifically, the display control unit 13 sets a first display mode in which given information displayed on the display unit 2 is selectable by a user operation when the detection unit 12 detects that the cabinet 1 is in the horizontal orientation (first orientation). That is, when the cabinet 1 is in the horizontal orientation, the user can switch the displayed data or select desired information by operating an operation button or touch panel provided for the frame of the cabinet 1.

The display control unit 13 sets a second display mode in which preset given information is displayed on the display screen when the detection unit 12 detects that the cabinet 1 is in the vertical orientation (second orientation). That is, when the cabinet 1 is in the vertical orientation, preset given information can be displayed on the display screen without a user intervention.

For example, the display control unit 13 may collectively display information frequently accessed by the user by setting the second display mode. The user may select and preset information to be displayed in the second display mode when the cabinet 1 is in the horizontal orientation, that is, when the first display mode is entered. As a result, only if the user changes the orientation of the cabinet 1 from horizontal to vertical, the user can switch the displayed data to the content item frequently accessed by the user, without searching for desired information.

Information frequently accessed by the user can be exemplified by daily weather, railway information, and news. As described above, the display control device 10 has a function of obtaining various types of information via the Internet etc. Information to be displayed in the second display mode may be obtained periodically or via the Internet when the orientation of the cabinet 1 changes from horizontal to vertical. A display example when the cabinet 1 is in the horizontal orientation and a display example when the cabinet 1 is in the vertical orientation will be described in detail later.

A vertical mode frame and a horizontal mode frame may be stored in the storage unit 15. In the horizontal orientation, that is, in the first display mode, the display control unit 13 obtains the horizontal mode frame stored in the storage unit 15 and displays given information using the frame. In the vertical orientation, that is, in the second display mode, the display control unit 13 obtains the vertical mode frame stored in the storage unit 15 and displays given information using the frame. This enables various types of information to be formatted for horizontal display or vertical display depending on the orientation of the cabinet 1.

As described above, the display control device 10 controls the display of an image displayed on the display unit 2 depending on whether the cabinet 1 is in the horizontal orientation or in the vertical orientation. However, the present invention is not limited to this example. When the detection unit 12 can detect that the cabinet 1 is slanted, display appropriate for the slanted display screen may be set. For example, when the cabinet 1 is slanted, an image that differs from the images for the vertical orientation and the horizontal orientation may be displayed. When the cabinet 1 is rotatable and the rotation speed can be detected by the detection unit 12, display may be controlled in accordance with the rotation speed. This enables successively taken images to be displayed while rotating the cabinet 1.

The function control unit 14 controls the function of the operation means 16 operated by the user, according to the orientation of the cabinet 1 detected by the detection unit 12. The function control unit 14 enables the operation means 16 when the display control unit 13 sets the first display mode and the function control unit 14 disables the operation means 16 when the display control unit 13 sets the second display mode. As described above, the operation means 16 is an operation button or touch panel provided for the frame of the cabinet 1.

The function control unit 14 allows the user to select various types of information or switch the display screen with the operation means 16 in the first display mode in which the cabinet 1 is in the horizontal orientation. In the second display mode in which the cabinet 1 is in the vertical orientation, it is difficult for the user to use the operation means 16. That is, when the cabinet 1 is in the vertical orientation, the display control unit 13 displays preset given information at all times and the operation means 16 may not switch the display screen or select information. As a result, when the cabinet 1 is in the vertical orientation, user operations are controlled appropriately to prevent the user from losing operations or executing incorrect operations.

In addition, when the operation means such as a touch panel is disabled, the display control unit 13 may turn off the back light of the touch panel. As a result, when the cabinet 1 is in the vertical orientation, the function and appearance of the display control device 10 become simple to make user operations easier.

The operation means 16 is provided at, for example, one end in the longitudinal direction of the rectangular-parallelepiped-shaped cabinet 1. For example, if the operation means such as an operation button and touch panel are present in a lower position in the longitudinal direction when the cabinet 1 is in the vertical orientation, the user has a difficulty in operating the operation means 16, thereby preventing the user from confusing operations.

[5] Operation of the Display Control Device

Figure 4:
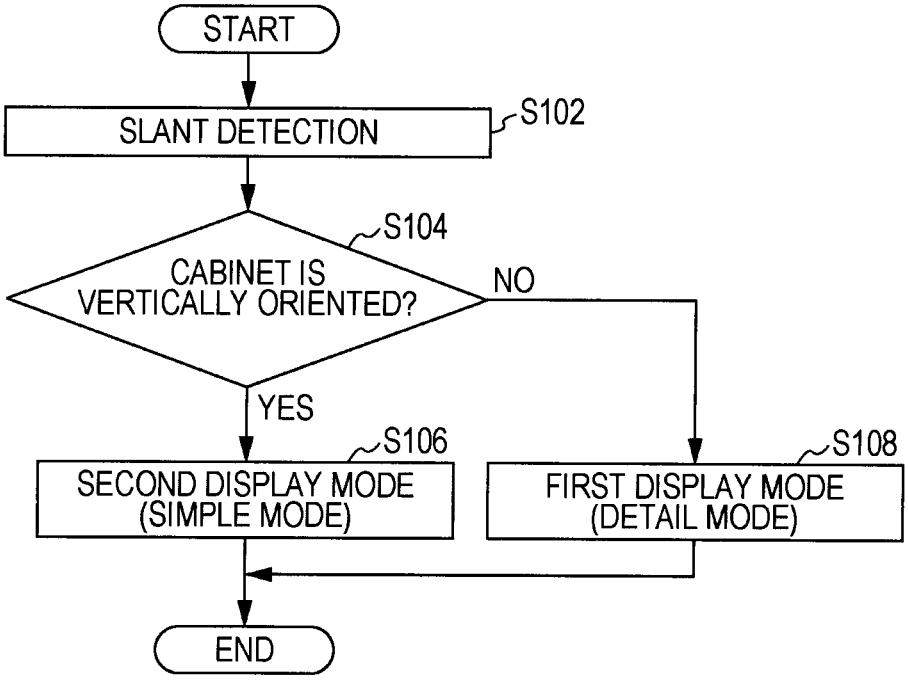
FIG. 4 is a flowchart illustrating the display control method of the display control device according to the embodiment.

The functional configuration of the display control device 10 has been described above. Next, the operation of the display control device 10 will be described with reference to FIG. 4. FIG. 4 is a flowchart illustrating the display control method of the display control device 10. As shown in FIG. 4, the detection unit 12 detects the slant of the cabinet 1 (step S102). As described above, the slant of the cabinet 1 is detected by the tilt sensor 11 and provided for the detection unit 12. The detection unit 12 detects the orientation of the cabinet 1 based on the slant provided by the tilt sensor 11.

The detection unit 12 determines whether the cabinet 1 is in the vertical orientation or in the horizontal orientation (step S104). As described above, when the longitudinal direction of the cabinet 1 equals the horizontal direction, the detection unit 12 decides that the cabinet 1 is in the first orientation (horizontal orientation). When the longitudinal direction of the cabinet 1 equals the vertical direction, the detection unit 12 decides that the cabinet 1 is in the second orientation (vertical orientation). The detection unit 12 determines whether the cabinet 1 is in the vertical orientation and provides the result for the display control unit 13 and the function control unit 14.

When the detection unit 12 determines that the cabinet 1 is in the vertical orientation in step S104, the display control unit 13 switches the display of the display unit 2 to the second display mode (step S106). In step S106, the function control unit 14 disables the operation means such as the operation button and the touch panel provided for the frame of the cabinet 1. In addition, the display control unit 13 may turn off the lamp disposed on the frame of the cabinet 1 to hide the indication for the operation button used during operation of the touch panel.

In the second display mode, or a "simple mode", preset information is displayed on the display screen without user intervention, as described above. In the simple mode, information frequently accessed by the user such as weather forecast, railway information, news is displayed collectively as described above. The simple mode eliminates user intervention, so the operation means such as the operation button is disabled and the function and appearance become simple.

Information to be displayed in the second display mode may be obtained via the Internet etc. when the cabinet 1 is in the vertical orientation. The information may also be obtained periodically to display the latest information at all times. A plurality of information items may be browsed with a slideshow.

When the detection unit 12 detects that the cabinet 1 is not in the vertical orientation, that is, in the horizontal orientation in step S104, the display control unit 13 switches the display of the display unit 2 to the first display mode (step S108). In step S108, the function control unit 14 enables the operation means such as the operation button and the touch panel provided for the frame of the cabinet 1. In addition, the display control unit 13 may turn on the lamp disposed on the frame of the cabinet 1 to display the indication for the operation button used during operation of the touch panel.

In the first display mode, or a user operable "detail mode", given information displayed in the display unit 2 is selectable by a user operation, as described above. In the detail mode, as described above, the user can switch the displayed data or select desired information using the operation button and the touch panel provided for the frame of the cabinet 1.

When the display control device 10 is shaped like a picture frame as shown in FIG. 1, the display control device 10 operates as a digital photo frame and generally displays images taken by the user or the like. Since the display control device 10 can obtain various types of information via the Internet etc., the display control device 10 can provide various types of information for the user in addition to operating as a digital photo frame.

Accordingly, when the cabinet 1 is in the horizontal orientation, the display control device 10 enters the user operable detail mode so as to obtain various types of information or previously select fixed information to be displayed when the cabinet 1 is in the vertical orientation.

As described above, only if the user changes the orientation of the cabinet 1 from horizontal to vertical, the user can switch the content item displayed on the display screen to the content item frequently accessed by the user, without searching for desired information. For example, when the display control device 10 is present in an easy-to-see place in a living room, only if the user changes the orientation of the cabinet 1 from horizontal to vertical even in a busy time in the morning, the user can obtain necessary information without performing troublesome searches.

[6] Display Example of the Display Control Device

Figure 5:
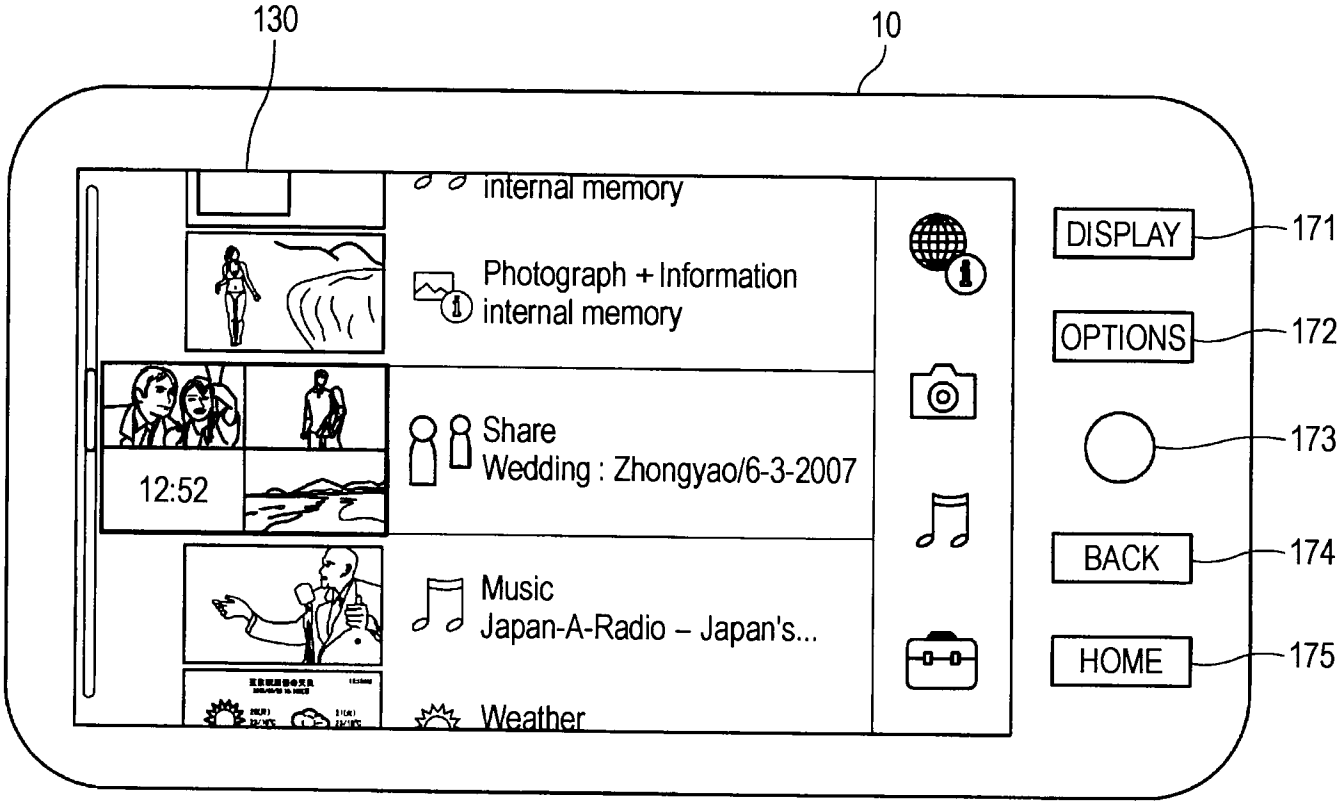
FIG. 5 illustrates a display example when a cabinet according to the embodiment is in a horizontal orientation.

The operation of the display control device 10 has been described above. Next, display examples of the display unit 2 will be described with reference to FIGS. 5 to 9. FIG. 5 illustrates a display example when the cabinet 1 is in the horizontal orientation. As shown in FIG. 5, when the cabinet 1 is in the horizontal orientation, a display screen 130, which is selectable by a user operation, appears.

The frame of the cabinet 1 is provided with an operation button 173, which can be slanted in four directions or pressed, and touch sensors 171, 172, 174, and 175. The operation button 173 can switch the menu displayed on the display unit 2 when the cabinet 1 is slanted in any of the four directions by a user operation. In addition, the operation button 173 can be pressed to select one menu item from a selection menu.

Each of the touch sensors 171, 172, 174, and 175 can be pressed by a user operation to perform a different function. Each of the touch sensors 171, 172, 174, and 175 is provided with an indication corresponding to each function. The indication is illuminated by a back light such as an LED lamp.

For example, the touch sensor 171 is provided with an indication "DISPLAY"; when the touch sensor 171 is pressed, additional information is displayed on the display unit 2. The touch sensor 172 is provided with an indication "OPTIONS"; when the touch sensor 172 is pressed, an option menu is displayed. The touch sensor 174 is provided with an indication "BACK"; when the touch sensor 174 is pressed, the hierarchical screen displayed immediately before appears again. The touch sensor 175 is provided with an indication "HOME"; when the touch sensor 175 is pressed, the HOME menu appears again.

As described above, when the cabinet 1 is in the horizontal orientation, the operation button 173 and the touch sensors 171, 172, 174, and 175 provided for the cabinet 1 are operated by the user to switch the screen or select given information.

FIG. 6 illustrates display examples when the cabinet 1 is in the horizontal orientation. As shown in FIG. 6, when the cabinet 1 is in the horizontal orientation, if the user selects, for example, a timetable item on the menu screen, a timetable screen 131 can be displayed. The user selects a timetable menu on the menu screen by operating the operation means such as the operation button described above. The user further selects a desired station from the timetable menu to display the timetable screen 131 on which the timetable of the station is indicated.

If the user selects a railway operational information item on the menu screen, an operational information screen 132 can be displayed. The user selects a railway operational information menu on the menu screen by operating the operation means such as the operation button described above. The user further selects a desired area etc. from the operational information menu to display the operational information screen 132 on which operational information of the area is indicated.

If the user selects a weather information item on the menu screen, a weather information screen 133 can be displayed. The user selects a weather information menu on the menu screen by operating the operation means such as the operation button described above. The user further selects a desired area etc. from the weather information menu to display the weather information screen 133 on which weather forecast of the area is indicated.

Figure 7:
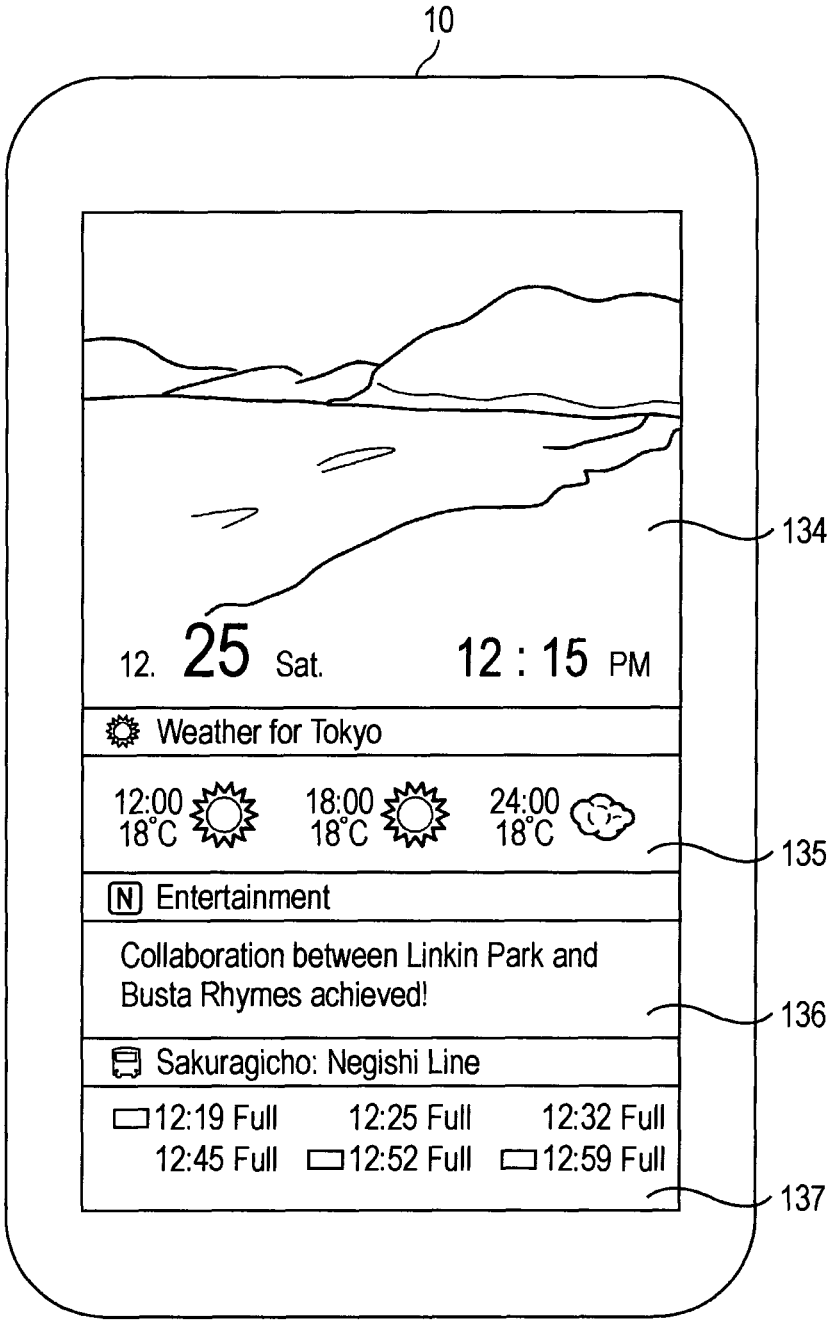
FIG. 7 illustrates a display example when a cabinet according to the embodiment is in a vertical orientation.

Next, a display example when the cabinet 1 is in the vertical orientation will be described below. FIG. 7 illustrates a display example when the cabinet 1 is in the vertical orientation. As shown in FIG. 7, preset given information items 135 to 137 are displayed on the display unit 2. The preset given information items include, for example, weather information 135, news 136, a timetable 137, etc. A photo image 134 taken by the user may be displayed together with the preset given information items 135 to 137. In addition, date and time may be displayed together with the photo image 134. As described above, in the second display mode applied when the cabinet 1 is in the vertical orientation, an integration screen including preset given information items collectively is displayed.

The preset given information items 135 to 137 are frequently searched for or accessed by the user. If there are a plurality of given information items, these items may be browsed with a slideshow. The photo image 134 may be a user's favorite photo image or a plurality of photo images displayed with a slideshow. In this way, the display unit 2 can display necessary information while functioning as a photo frame.

As described above, only if the user changes the orientation of the cabinet 1 from horizontal to vertical, the user can switch the content item displayed on the display screen to the content item frequently accessed by the user, without searching for desired information.

When the cabinet 1 is in the vertical orientation, the touch sensors displayed when the cabinet 1 is in the horizontal orientation are hidden. In addition, the operation means such as the operation button and the touch sensors are disabled. As a result, when the cabinet 1 is in the vertical orientation, user operations are controlled appropriately to prevent the user from losing operations or executing incorrect operations. In addition, when the cabinet 1 is in the vertical orientation, the function and appearance of the display control device 10 become simple to make user operations easier.

Figure 8:
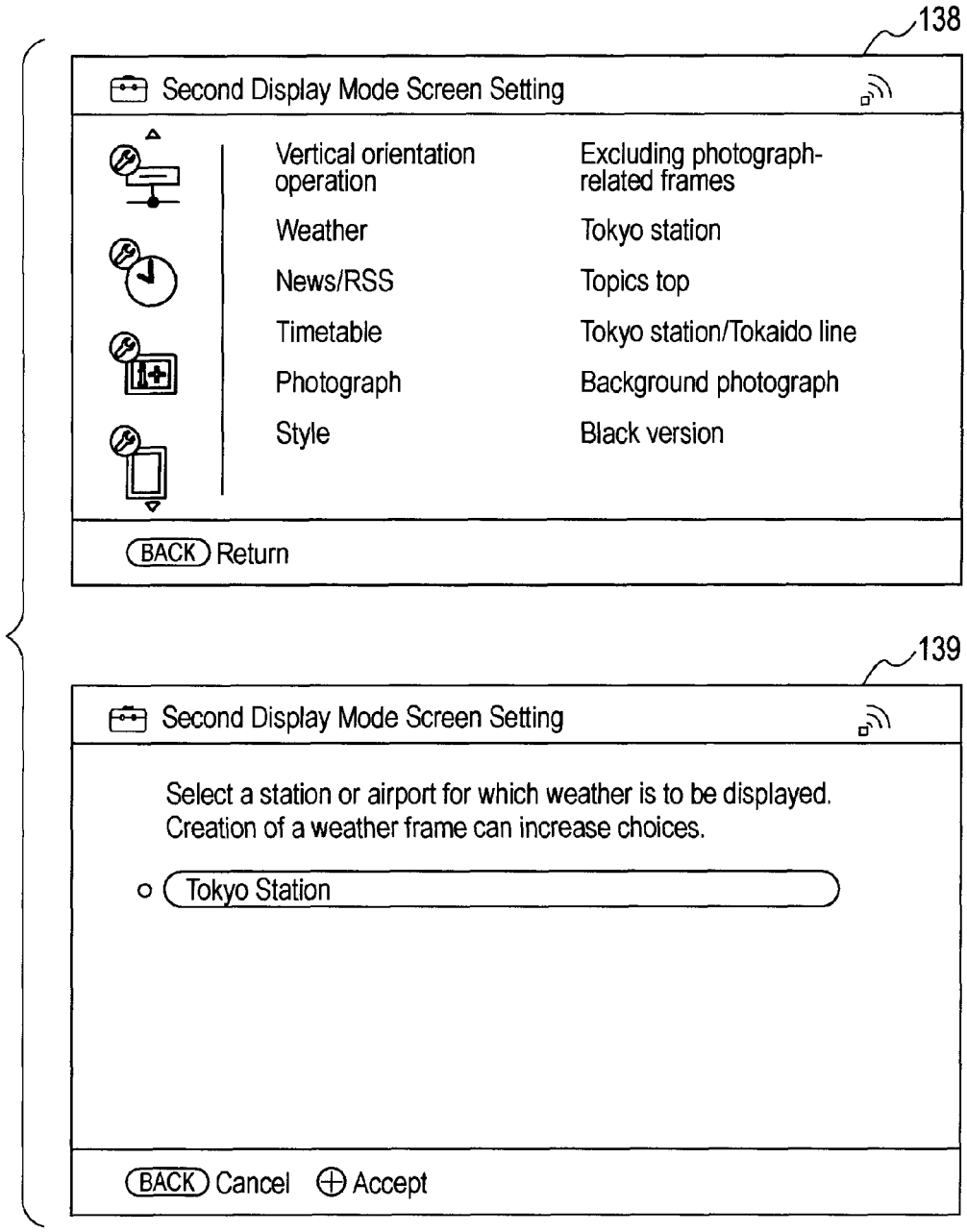
FIG. 8 illustrates an exemplary setting screen for presetting given information according to the embodiment.

The given information to be displayed when the cabinet 1 is in the vertical orientation may be preset when the cabinet 1 is in the horizontal orientation. FIG. 8 is an exemplary setting screen used when the cabinet 1 is in the horizontal orientation to preset the given information to be displayed when the cabinet 1 is in the vertical orientation. When the cabinet 1 is in the horizontal orientation, the user selects, from the menu screen, a menu for setting the screen to be displayed in the second display mode as described above.

For example, when the user wants to display weather information near the Tokyo station in the second display mode, the user selects "Weather" on a setting screen 138. Next, the user selects "Tokyo station" on the setting screen 138. Then, weather information of the Tokyo station is displayed at all times in the second display mode in which the cabinet 1 is in the vertical orientation.

Figure 9:
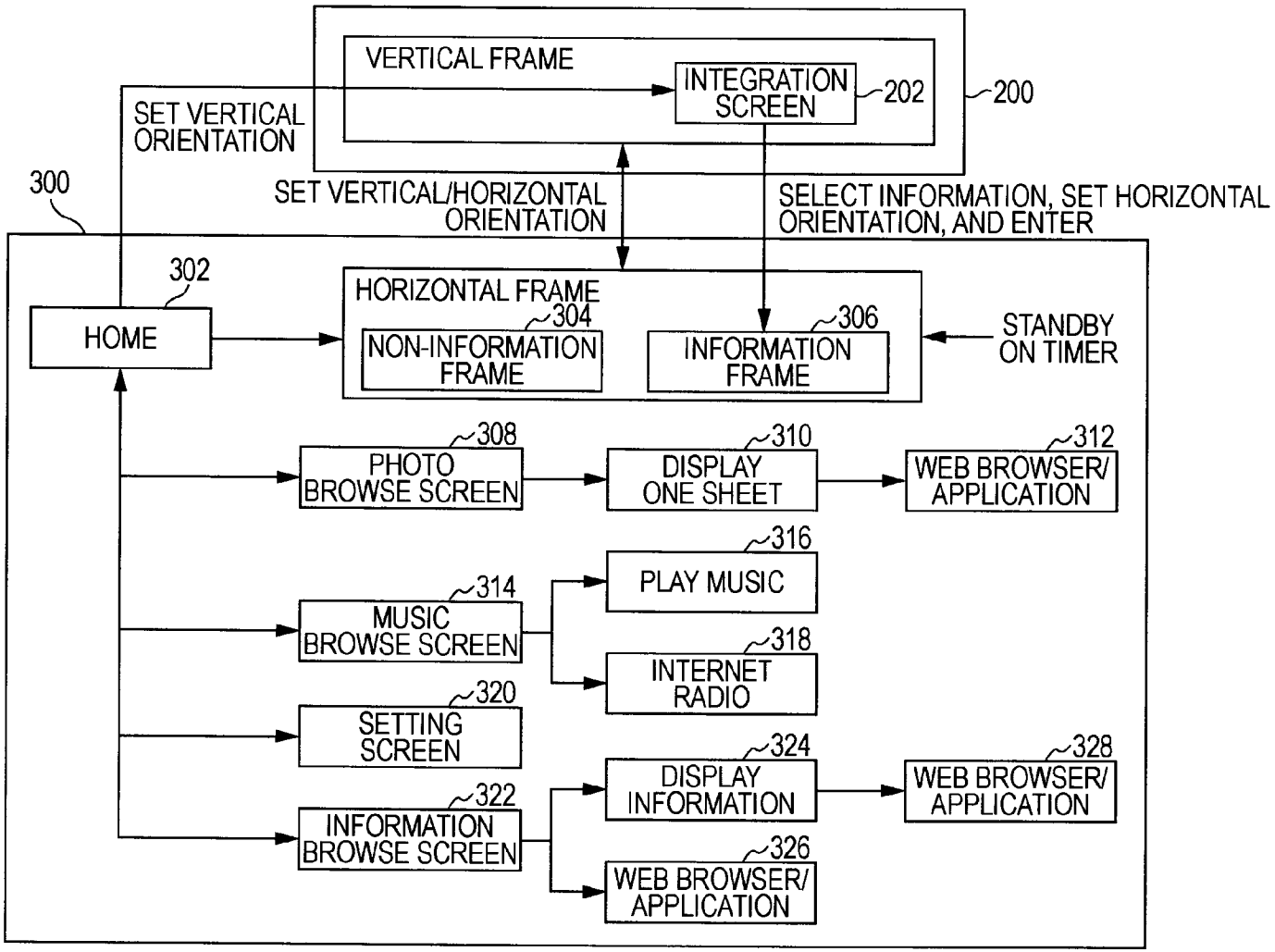
FIG. 9 illustrates display depending on the horizontal or vertical orientation of the cabinet according to the embodiment of the present invention.

Next, what is displayed depending on the vertical or horizontal orientation of the cabinet 1 will be described with reference to FIG. 9. When the cabinet 1 is in the vertical orientation, an integration screen 202, on which preset given information, a photo image, and date/time are integrated, appears. In this case, the integration screen 202 is displayed with a frame suited for portrait display.

When the cabinet 1 is in the horizontal orientation, either a non-information frame 304 or an information frame 306 is selected. The non-information frame 304 is used to display a photo image etc. The information frame 306 is used to display, for example, a menu screen for searching for various types of information. The display screen that appears when the cabinet 1 is in the horizontal orientation can be exemplified by a photo browse screen 308, a music browse screen 314, a setting screen 320, or an information browse screen 322. Display examples that appear on the display unit 2 when the cabinet 1 is in the horizontal orientation and in the vertical orientation have been described above.

In the display control device 10 of the present embodiment, display can be switched or the function of operation means such as the operation button can be controlled appropriately in accordance with the detected orientation of the cabinet 1. For example, when the cabinet 1 is in the horizontal orientation, given information is selectable by a user operation; when the cabinet 1 is in the vertical orientation, preset given information can be displayed on the display screen. Only if the user changes the orientation of the cabinet 1 from horizontal to vertical, the user can switch the content item on the display screen to the content item frequently accessed by the user, without searching for desired information.

The present application contains subject matter related to that disclosed in Japanese Priority Patent Application JP 2009-001155 filed in the Japan Patent Office on Jan. 6, 2009, the entire content of which is hereby incorporated by reference.

The preferred embodiment of the present invention has been described above with reference to the drawings, but the present invention is not limited to these examples. It should be understood by those skilled in the art that various modifications, combinations, sub-combinations and alterations may occur depending on design requirements and other factors insofar as they are within the scope of the appended claims or the equivalents thereof.

What is claimed is:

1. A display control device comprising:

a cabinet;

a detection unit configured to detect whether the cabinet is in a first orientation of one of a portrait or a landscape orientation, or in a second orientation of the other one of the portrait or the landscape orientation, in accordance with a slant of the cabinet;

an operation means operated by a user and comprising an operation button;

a display screen; and a display control unit configured to control display of the display screen in accordance with the detected orientation of the cabinet, wherein the operation button is a physical button, wherein the display control unit sets the display screen to a first display mode when the cabinet is detected to be the first orientation, and sets the display screen to a second display mode different from the first display mode when the cabinet is detected to be in the second orientation, and wherein, in the first display mode, the operation button of the operation means is enabled to allow for an operation to be performed upon operation of the operation button by a user, and, in the second display mode, the operation button of the operation means is disabled and user intervention and interaction with a displayed content displayed on the display screen is prohibited.

2. The display control device of claim 1, further comprising:

a function control unit configured to control a function of the operation means in accordance with the orientation of the cabinet detected by the detection unit.

3. The display control device of claim 2, wherein the display control unit controls display of the operation button corresponding to the operation means in accordance with the orientation of the cabinet detected by the detection unit.

4. The display control device of any one of claims 1 to 3, wherein the first display mode comprises a mode in which given information displayed on the display screen is selectable by a user operation; and the second display mode comprises a mode in which preset given information is displayed on the display screen.

5. The display control device of claim 4, wherein the cabinet is rectangular-parallelepiped-shaped; and a longitudinal direction of the cabinet is a horizontal direction in the first orientation, and the longitudinal direction of the cabinet is a vertical direction in the second orientation.

6. The display control device of claim 5, wherein the operation means is provided at one end in the longitudinal direction of the rectangular-parallelepiped-shaped cabinet;

the display control unit displays the operation button corresponding to the operation means when the cabinet is in the first orientation; and the function control unit enables the operation means when the display control unit displays the operation button.

7. The display control device of claim 6, wherein the display control unit hides the operation button corresponding to the operation means when the cabinet is in the second orientation; and the function control unit disables the operation means when the display control unit hides the operation button.

8. The display control device of claim 6, wherein the display control unit hides the operation button by controlling the display of the operation button such that the operation button is made so as not to be visible to the user or a lighting of the operation button is turned off.

9. The display control device of claim 1, wherein when the display control unit sets the display screen to the second display mode, a preset given information is displayed on the display screen.

10. The display control device of claim 9, wherein the preset given information comprises at least one content item frequently accessed by the user.

11. The display control device of claim 9, wherein the preset given information comprises current information obtained via the internet.

12. The display control device of claim 11, wherein the preset given information comprises at least one of a weather information, a railway information, and a news information.

13. The display control device of claim 9, wherein the preset given information is displayed on the display screen as a slideshow of a plurality of images.

14. The display control device of claim 1, wherein an image displayed on the display screen in the first display mode is different than an image displayed on the display screen in the second display mode.

15. The display control device of claim 1, wherein the operation button is provided within a frame of the cabinet, apart from the display screen.

16. A display control method comprising the steps of:

detecting a slant of a cabinet;

determining whether the cabinet is in a first orientation of one of a portrait or a landscape orientation, or in a second orientation of the other one of the portrait or the landscape orientation, in accordance with the detected slant of the cabinet;

controlling display of a display screen in accordance with the determined orientation of the cabinet;

setting the display screen to a first display mode in which given information displayed on the display screen is selectable by a user operation when the cabinet is in the first orientation; and setting the display screen to a second display mode in which preset given information is displayed on the display screen when the cabinet is in the second orientation, wherein, in the first display mode, an operation button configured as a physical button and to be operable by a user is enabled to allow for an operation to be performed upon operation of the operation button by the user, and, in the second display mode, the operation button is disabled and user intervention and interaction with a displayed content displayed on the display screen is prohibited.

17. A non-transitory computer-readable medium having embodied thereon a program, which when executed by a computer causes the computer to perform a display control method, the method comprising:

detecting a slant of a cabinet;

determining whether the cabinet is in a first orientation of one of a portrait or a landscape orientation, or in a second orientation of the other one of the portrait or the landscape orientation, in accordance with the detected slant of the cabinet;

controlling display of a display screen in accordance with the determined orientation of the cabinet;

setting the display screen to a first display mode in which given information displayed on the display screen is selectable by a user operation when the cabinet is in the first orientation; and setting the display screen to a second display mode in which preset given information is displayed on the display screen when the cabinet is in the second orientation, and wherein, in the first display mode, an operation button configured as a physical button and to be operable by a user is enabled to allow for an operation to be performed upon operation of the operation button by the user, and, in the second display mode, the operation button is disabled and user intervention and interaction with a displayed content displayed on the display screen is prohibited.

* * * * *